US008884995B2

(12) United States Patent
Kwak et al.

(10) Patent No.: US 8,884,995 B2
(45) Date of Patent: Nov. 11, 2014

(54) SYSTEM FOR COMPENSATING FOR GAMMA DATA, DISPLAY DEVICE INCLUDING THE SAME AND METHOD OF COMPENSATING FOR GAMMA DATA

(75) Inventors: Young-Sun Kwak, Cheonan-si (KR); Nam-Suk Bang, Hwaseong-si (KR); Ji-Won Kim, Cheonan-si (KR); Won-Hee Lee, Bucheon-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 305 days.

(21) Appl. No.: 13/289,354

(22) Filed: Nov. 4, 2011

(65) Prior Publication Data

US 2012/0320098 A1 Dec. 20, 2012

(30) Foreign Application Priority Data

Jun. 17, 2011 (KR) ..... 10-2011-0059200

(51) Int. Cl.
*G09G 5/10* (2006.01)
*G09G 3/20* (2006.01)

(52) U.S. Cl.
CPC ..... *G09G 3/2003* (2013.01); *G09G 2320/0285* (2013.01); *G09G 2320/0276* (2013.01); *G09G 2320/029* (2013.01); *G09G 2320/0673* (2013.01); *G09G 2300/0426* (2013.01)
USPC ..... 345/690; 345/89

(58) Field of Classification Search
USPC ..... 345/76, 77, 87, 89, 690, 83
See application file for complete search history.

(56) References Cited

U.S. PATENT DOCUMENTS

| | | | | |
|---|---|---|---|---|
| 7,148,868 | B2 | 12/2006 | Lee | |
| 7,755,578 | B2 * | 7/2010 | Park et al. | 345/76 |
| 8,558,766 | B2 * | 10/2013 | Kwon | 345/77 |
| 2002/0030647 | A1 * | 3/2002 | Hack et al. | 345/82 |
| 2003/0210212 | A1 * | 11/2003 | Li et al. | 345/76 |
| 2007/0164937 | A1 * | 7/2007 | Jung et al. | 345/76 |
| 2008/0252568 | A1 * | 10/2008 | Kwon | 345/76 |
| 2008/0266506 | A1 | 10/2008 | Takenaka et al. | |
| 2009/0184654 | A1 | 7/2009 | Fukumoto | |
| 2010/0053056 | A1 * | 3/2010 | Lee et al. | 345/94 |
| 2010/0066709 | A1 * | 3/2010 | Yajima | 345/204 |
| 2010/0214273 | A1 * | 8/2010 | Shirouzu et al. | 345/205 |

FOREIGN PATENT DOCUMENTS

| | | |
|---|---|---|
| JP | 2006-284837 | 10/2006 |
| JP | 2008-158488 | 7/2008 |
| JP | 2009-199067 | 9/2009 |
| KR | 1020070065044 | 6/2007 |

(Continued)

*Primary Examiner* — Chanh Nguyen
*Assistant Examiner* — Roy Rabindranath
(74) *Attorney, Agent, or Firm* — F. Chau & Associates, LLC

(57) ABSTRACT

A system for compensating for gamma data is provided comprising a display panel including at least one feedback line connected to at least one pixel, a gray voltage generator generating a reference gray voltage based on first gamma data, a data driver generating a data voltage based on the reference gray voltage and applying the generated data voltage to a data line, a multiplexer receiving at least one feedback voltage from the at least one feedback line and selecting a feedback voltage from the received at least one feedback voltage and outputting the selected feedback voltage, an A/D converter converting the selected feedback voltage into feedback data, and a signal controller storing the feedback data as feedback gamma data for the entire grays and compensating for the first gamma data based on the feedback gamma data.

18 Claims, 8 Drawing Sheets

(56) References Cited

FOREIGN PATENT DOCUMENTS

| | | |
|---|---|---|
| KR | 1020070098365 | 10/2007 |
| KR | 1020080012674 | 2/2008 |
| KR | 1020080030903 | 4/2008 |
| KR | 1020080043009 | 5/2008 |
| KR | 1020080043081 | 5/2008 |
| KR | 1020080062546 | 7/2008 |
| KR | 1020090114274 | 11/2009 |
| KR | 1020100086231 | 7/2010 |
| KR | 1020100090870 | 8/2010 |

* cited by examiner

SYSTEM FOR COMPENSATING FOR GAMMA DATA, DISPLAY DEVICE INCLUDING THE SAME AND METHOD OF COMPENSATING FOR GAMMA DATA

CROSS-REFERENCE TO RELATED APPLICATION

This application claims priority to and the benefit of Korean Patent Application No. 10-2011-0059200 filed in the Korean Intellectual Property Office on Jun. 17, 2011, the entire contents of which are herein incorporated by reference.

BACKGROUND (a) Technical Field

The embodiments of the present invention relate to a system for compensating for gamma data, a display device including the system, and a method of compensating for gamma data, and more particularly, to a system for compensating for gamma data using a feedback voltage of a display device, a display device including the system, and a method of compensating for gamma data using a feedback voltage.

(b) Discussion of the Related Art

A flat panel display, such as a liquid crystal display, is used for a desktop computer, a television, and the like.

A liquid crystal display panel, which is one of the flat panel displays, includes two sheets of substrates with electrodes, such as pixel electrodes and a common electrode for generating electric fields, and a liquid crystal layer interposed between the substrates. The liquid crystal display generates electric fields in the liquid crystal layer by applying voltage to the electrodes and controls the alignment of liquid crystal molecules of the liquid crystal layer and polarization of incident light by the generated electric field, thereby displaying images.

Although electric and optical characteristics for pixels for red (R), green (G), and blue (B) are different from each other, the display device uses the same electric signals for the R, G, and B pixels under the assumption that the electric and optical characteristics are the same as each other. However, when the gamma characteristics for red, green, and blue are independently measured, a result shows that the gamma characteristics do not coincide with each other. As a result, colors for each gray are irregular or biased. Accordingly, a display device has been developed, which performs adaptive color correction (ACC) by independently modifying a gamma curve of each of R, G, and B in addition to general gamma correction.

However, since display devices have their own variations in characteristics of the display device due to various processing and operational factors, it does not ensure the same display characteristics when the same gamma data and color correction data are applied to each of the display devices.

SUMMARY

Exemplary embodiments of the present invention provide a system for compensating for gamma data, a display device including the same, and a method of compensating for gamma data that can compensate for gamma data (e.g., gamma data for white) or R, G, B independent gamma data to be suitable for each display device, thereby improving productivity and reliability of the display device.

According to an exemplary embodiment of the present invention, there is provided a system for compensating for gamma data, including a display panel including a plurality of pixels arranged in a matrix form, a plurality of data lines and a plurality of gate lines connected to the plurality of pixels, and at least one feedback line connected to at least one pixel of the plurality of pixels, a gray voltage generator generating a reference gray voltage based on first gamma data, a data driver generating a data voltage based on the reference gray voltage and applying the generated data voltage to a data line of the plurality of data lines, a multiplexer receiving at least one feedback voltage from the at least one feedback line, selecting a feedback voltage from the received at least one feedback voltage, and outputting the selected feedback voltage, an A/D converter converting the feedback voltage selected by the multiplexer into feedback data, and a signal controller storing the feedback data as feedback gamma data for the entire grays and compensating for the first gamma data based on the feedback gamma data.

The signal controller includes a lookup table storing the feedback gamma data and a comparison processor comparing the feedback gamma data with target gamma data and compensating for the first gamma data when the feedback gamma data departs from a dispersion range.

When the feedback gamma data is within the dispersion range, the signal controller may store the first gamma data as final gamma data in the lookup table.

The feedback gamma data and the first gamma data may be gamma data for white or green.

The feedback gamma data and the first gamma data may be gamma data for each of red, green, and blue.

Each of the plurality of pixels includes a switching element including an input terminal which is connected to the data line and a pixel electrode connected to an output terminal of the switching element, and at least one of the output terminal of the switching element and the pixel electrode may be connected to the feedback line.

The feedback line may be disposed in the same layer as the pixel electrode, and the feedback line and the pixel electrode may include a transparent conductive material.

The plurality of gate lines may extend in a row direction, and the data line and the feedback line may extend in a column direction.

According to an exemplary embodiment of the present invention, there is provided a display device including the gamma data compensation system.

According to an exemplary embodiment of the present invention, there is provided a method of compensating for gamma data, including generating and outputting a data voltage based on first gamma data, feeding back at least one pixel voltage charged in at least one pixel, selecting feedback voltage from the at least one pixel voltage, converting the selected feedback voltage into feedback data, storing the feedback data as feedback gamma data for the entire grays, comparing the feedback gamma data with target gamma data to determine whether the feedback gamma data is within a dispersion range, compensating for the first gamma data based on the feedback gamma data when the feedback gamma data departs from the dispersion range, and storing the first gamma data as final gamma data when the feedback gamma data is within the dispersion range.

Generating and outputting the data voltage based on the first gamma data is performed for each gray of the entire grays.

The method of compensating for gamma data further includes generating and outputting a data voltage based on the compensated first gamma data.

The feedback gamma data and the first gamma data are gamma data for white.

Selecting the feedback voltage includes selecting pixel voltages charged in three pixels representing different colors.

Selecting the feedback voltage includes selecting a pixel voltage charged in a pixel representing green.

The feedback gamma data and the first gamma data are gamma data for each of red, green, and blue.

Selecting the feedback voltage includes selecting a pixel voltage charged in a pixel representing one color.

The at least one pixel includes a switching element and a pixel electrode connected to the switching element. Feeding back the at least one pixel voltage includes using a feedback line connected to at least one of an output terminal of the switching element and the pixel electrode.

According to the exemplary embodiments of the present invention, based on a feedback voltage from a display panel of a display device, feedback gamma data is obtained, which is used to compensate for gamma data (e.g., gamma data for white) or R, G, B independent gamma data thereby obtaining optimal gamma data suitable for the display panel. Therefore, it is possible to improve display characteristics and reliability of the display device.

DETAILED DESCRIPTION OF THE EMBODIMENTS

Figure 1:
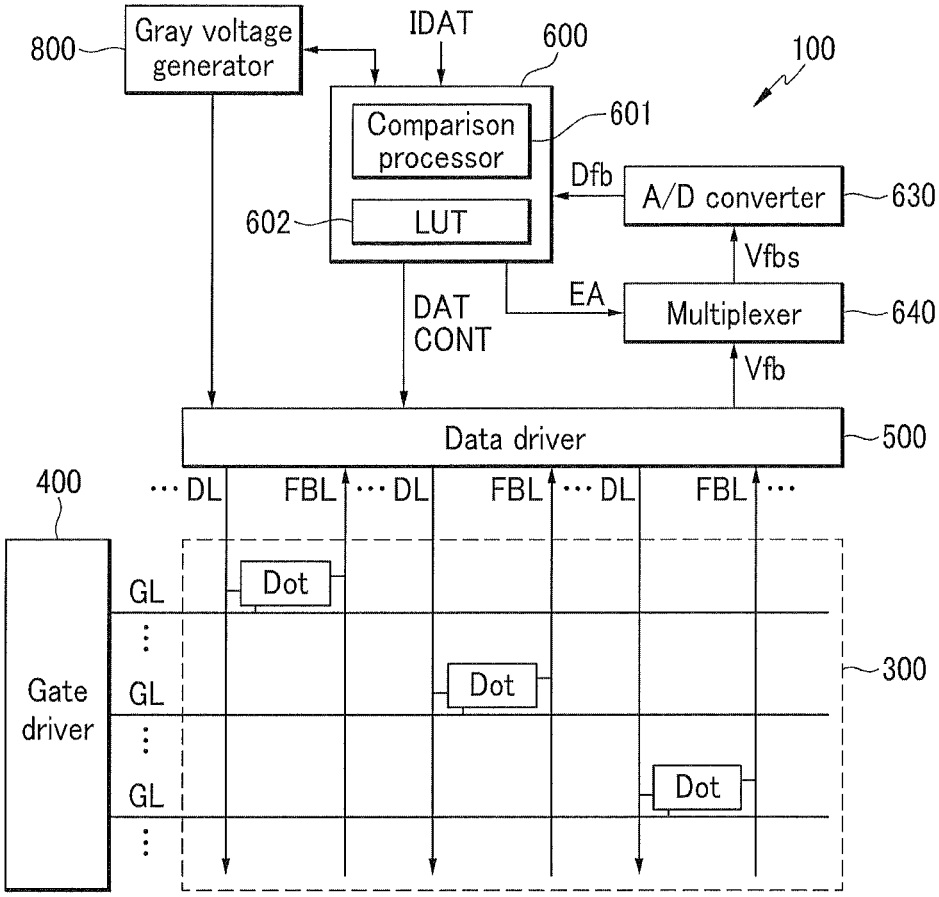
FIG. 1 is a block diagram of a display device including a system for compensating for gamma data according to an exemplary embodiment of the present invention.

Exemplary embodiments of the present invention will be hereinafter described in greater detail with reference to the accompanying drawings, in which the same element numerals may be used to denote the same or substantially the same elements throughout the specification and the drawings.

In the drawings, the thickness of layers, films, panels, regions, etc., may be exaggerated for clarity. It will be understood that when an element such as a layer, film, region, or substrate is referred to as being "on" another element, it can be directly on the other element or intervening elements may also be present.

As will be appreciated by one skilled in the art, aspects of the present inventive concept may be embodied as a system, method or computer program product. Accordingly, aspects of the present inventive concept may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present inventive concept may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a RAM, a ROM, an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present inventive concept may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present inventive concept are described with reference to flowchart illustrations and/or block diagrams of methods, apparatus (systems) and computer program products according to embodiments of the inventive concept. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article or manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present inventive concept. In this regard, each block in the flowchart or block diagrams may represent a module, segment, or portion of code, which comprises one or more executable instructions for implementing the specified logical functions (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Figure 2:
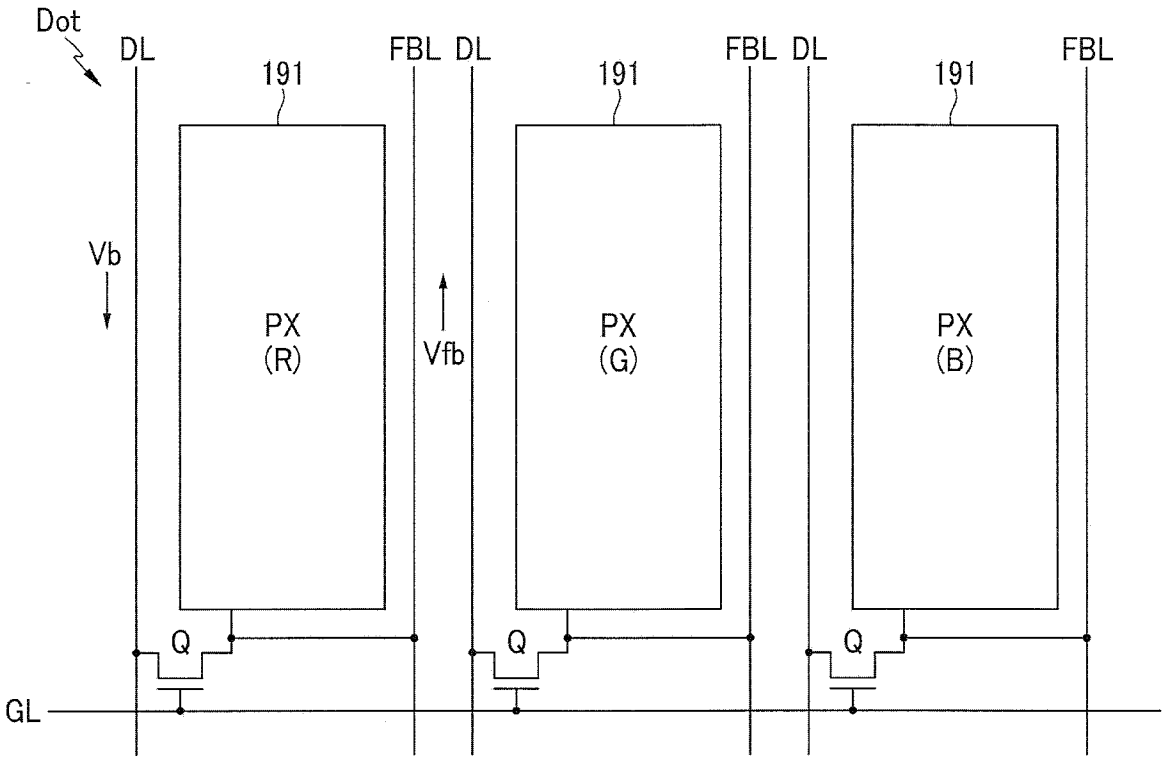
FIG. 2 is a layout view showing a method of applying a data voltage and a feedback method of a pixel voltage in a display device according to an exemplary embodiment of the present invention.

FIG. 1 is a block diagram of a display device including a system for compensating for gamma data according to an exemplary embodiment of the present invention, and FIG. 2 is a layout view for describing a data voltage applying method and a pixel voltage feedback method in a display device according to an exemplary embodiment of the present invention.

Referring to FIG. 1, a display device according to an exemplary embodiment of the present invention includes a system 100 for compensating for gamma data (referred to as a "gamma data compensation system 100"). The gamma data compensation system 100 includes a display panel 300, a gate driver 400, a data driver 500, a gray voltage generator 800, a signal controller 600, an A/D converter 630, and a multiplexer (MUX) 640

The display panel 300 is connected with a plurality of signal lines GL, DL, and FBL and includes a plurality of pixels PX which are arranged substantially in a matrix form.

The signal lines GL, DL, and FBL include a plurality of gate lines GL through which gate signals (also referred to as "scanning signals") are transmitted, a plurality of data lines DL through which data voltages, such as a data voltage Vd, are transmitted, and a plurality of feedback lines FBL through which feedback voltages, such as a feedback voltage Vfb, are transmitted. The feedback lines FBL are connected with the multiplexer 640 through the data driver 500. According to an embodiment, the feedback lines FBL are directly connected with the multiplexer 640. The gate lines GL extend substantially in a row direction, and the data lines DL and feedback lines FBL extend substantially in a column direction. The feedback lines FBL are formed at every pixel column or at every a few pixel columns, or are formed only at a few pixel columns.

Referring to FIGS. 1 and 2, each pixel PX includes a switching element Q connected to a signal line, such as the gate line GL, the data line DL, or the like, and a pixel electrode 191 connected to the switching element Q. The switching element Q is a three-terminal element, such as a thin film transistor or the like. A control terminal of the switching element Q is connected with a corresponding gate line GL, an input terminal of the switching element Q is connected to a corresponding data line DL, and an output terminal of the switching element Q is connected to a corresponding pixel electrode 191. The output terminal of the switching element Q or the pixel electrode 191 is connected to the feedback line FBL which is adjacent to a corresponding pixel PX.

Each pixel PX displays one of primary colors, and a desired color is made by spatially and temporally combining the primary colors. An example of the primary colors includes red R, green G, and blue B. Each pixel PX includes a color filter (not shown) at a region corresponding to each pixel electrode 191 to represent one of the primary colors. A red pixel R representing red, a green pixel G representing green, and a blue pixel representing blue constitute one dot which is a unit for implementing a desired color. Referring to FIG. 1, a plurality of dots are arranged on the display panel in a matrix form.

The gate driver 400 is connected with the gate lines GL of the display panel 300 and applies gate signals, which are configured by combining a gate-on voltage Von turning on the switching element Q and a gate-off voltage Voff turning off the switching element Q, to the gate lines GL.

The data driver 500 is connected with the data lines DL of the display panel 300. The data driver 500 selects gray voltages from the gray voltage generator 800 and applies the selected gray voltages as data voltages Vd to the data lines DL. However, when the gray voltage generator 800 provides not all the gray voltages but only a limited number of reference gray voltages, the data driver 500 divides the reference gray voltages to generate desired data voltages Vd. The data voltages Vd applied to the data lines DL of the display panel 300 are transmitted to the pixel electrodes 191 of respective corresponding pixels PX through respective corresponding switching elements Q and are maintained as pixel voltages.

The multiplexer 640 receives at least one pixel voltage charged in at least one pixel PX of the display panel 300 as a feedback voltage Vfb. The feedback voltage Vfb is transmitted through the feedback line FBL and the data driver 500 to the multiplexer 640. According to an embodiment, the feedback voltage Vfb which has passed through the data driver 500 is directly received at the multiplexer 640.

The multiplexer 640 selects a feedback voltage Vfbs which corresponds to a pixel PX of a desired position among at least one inputted feedback voltage Vfb according to an enable signal EA from the signal controller 600. According to an embodiment, the selected feedback voltage Vfbs is a feedback voltage for one pixel PX. Since a loss of the feedback voltage Vfbs transmitted through the feedback line FBL varies according to a position of the pixel PX, the feedback voltage Vfbs is selected considering the loss.

The A/D converter 630 converts the feedback voltage Vfbs selected from the multiplexer 640 into feedback data Dfb of a predetermined bit number and transmits the converted feedback data to the signal controller 600.

The signal controller 600 controls the gate driver 400, the data driver 500, the gray voltage generator 800, and the multiplexer 640. The signal controller 600 includes a comparison processor 601 and a lookup table (LUT) 602.

The signal controller 600 receives an input image signal IDAT from an outside source (not shown) and generates an output image signal DAT and a data control signal CONT which are transmitted to the data driver 500. According to an exemplary embodiment, the input image signal IDAT for compensating for gamma data is an image signal which represents one of grays that are incremented from a minimum value (for example, "0") to a maximum value (for example, "255"). The output image signal DAT is a digital signal and has one of a plurality of grays (e.g., 255 grays). The data control signal CONT includes a scan mode start signal for applying a data voltage Vd for each gray to the data line DL.

The lookup table 602 of the signal controller 600 stores gamma data corresponding to a stored gamma curve or R, G, B independent gamma data. The lookup table 602 stores the feedback data Dfb for all the grays inputted from the A/D converter 630 as feedback gamma data.

The comparison processor 601 of the signal controller 600 compensates for the gamma data stored in the lookup table 602 based on the feedback gamma data stored in the lookup table 602. According to an embodiment, the feedback gamma data is compared with target gamma data to compensate for the gamma data to be suitable for the target gamma data.

According to an embodiment, the target gamma data is separately provided or is the gamma data itself before compensation.

The gray voltage generator 800 receives the compensated gamma data from the signal controller 600 to generate the entire gray voltages or a limited number of reference gray voltages. The entire gray voltages or the reference gray voltages include a positive voltage value and a negative voltage value with respect to a common voltage Vcom.

Hereinafter, an operation of a method of compensating for gamma data according to an exemplary embodiment of the present invention is described with reference to FIGS. 3 and 4 in addition to FIGS. 1 and 2 described above.

Figure 3:
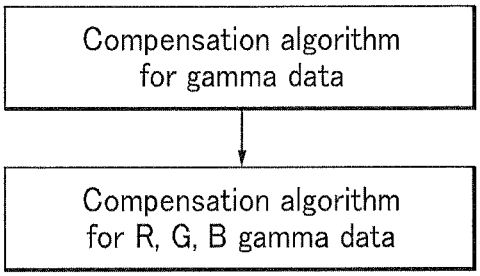
FIGS. 3 and 4 are flowcharts illustrating a method of compensating for gamma data according to an exemplary embodiment of the present invention.
Figure 4:
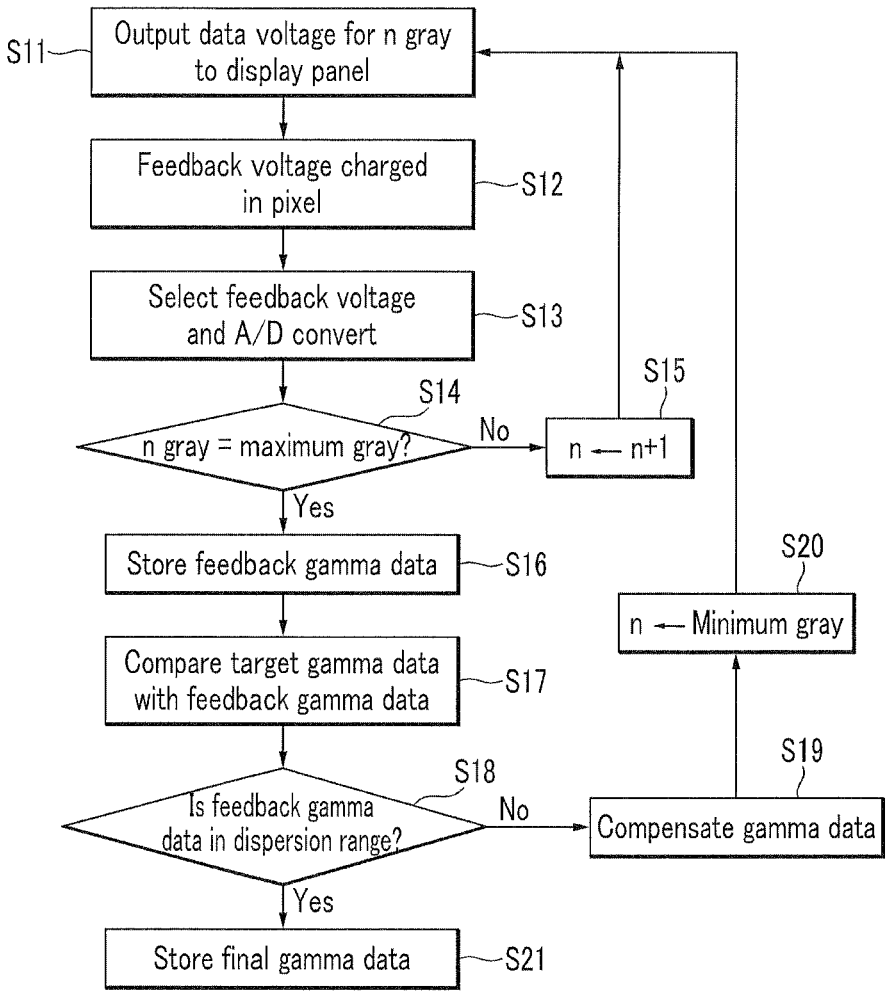

FIGS. 3 and 4 are flowcharts illustrating a method of compensating for gamma data according to an exemplary embodiment of the present invention.

Referring to FIG. 3, a method of compensating for gamma data according to an exemplary embodiment of the present invention performs a compensation algorithm for gamma data and then performs a compensation algorithm for gamma data of each of R, G, and B. According to an embodiment, compensating for the gamma data is substituted by compensating for gamma data for white or by compensating for gamma data for green G. The compensation for the R, G, B independent gamma data is performed by feedback and compensation for R and B gamma data.

Referring to FIG. 4, a method of compensating for gamma data (e.g., gamma data for white) or gamma data for each of R, G, and B is as described below. As used herein, the gamma data for each of R, G, and B are simply referred to as "R, G, B independence gamma data".

The data driver 500 outputs a data voltage Vd corresponding to an nth gray (e.g., n is one of 0 to 255) to the display panel 300 according to the scan mode start signal CONT from the signal controller 600 (S11).

The signal controller 600 converts an input image signal IDAT for the nth gray into an output image signal DAT and transmits the converted output image signal DAT to the data driver 500. According to an exemplary embodiment, the nth gray is 0 gray which is a minimum gray in a first frame and increases one by one in subsequent frames. The data driver 500 selects a gray voltage corresponding to the output image signal DAT, converts the selected gray voltage into an analog data voltage Vd and applies the converted analog data voltage Vd to the data line DL.

The gate driver 400 applies gate-on voltages Von to the gate lines GL in sequence according to the gate control signal from the signal controller 600 to turn on the switching elements Q connected to the gate lines GL. Then, the data voltage Vd of the nth gray from the data line DL is sequentially applied to the corresponding pixel PX through the turned-on switching element Q. The data voltage Vd applied to the pixel PX is represented as a pixel voltage and is maintained during a corresponding frame. The pixel voltage can display luminance represented by the gray of the input image signal IDAT.

According to an embodiment, in the case of the gamma data compensating algorithm, an image for white is displayed and in the case of the independent gamma data compensating algorithm for each of R, G, and B, an image for each of R, G, and B is separately displayed.

Next, the pixel voltage which is charged in the pixel PX is transmitted through the feedback line FBL of the display panel 300 to the multiplexer 640 as a feedback voltage Vfb (S12). According to an embodiment, a plurality of feedback voltages Vfb for a plurality of pixels PX are transmitted through respective corresponding feedback lines FBL to the multiplexer 640.

The multiplexer 640 selects a feedback voltage Vfbs which corresponds to a pixel PX of a desired position (e.g., a center of a screen or R, G, and B pixels) among the plurality of input feedback voltages Vfb according to an enable signal EA from the signal controller 600. The selection is performed according to scan timing of the gate driver 400 (S13). The selected feedback voltage Vfbs is a feedback voltage Vfb for one of R, G, and B pixels PX with respect to the nth gray or is a set of feedback voltages Vfb for one dot. According to an embodiment, in the case where the feedback voltage Vfb inputted from the display panel 300 is for one pixel PX or one dot, the selection process is omitted.

According to an embodiment, since a loss of the feedback voltage Vfbs transmitted along the feedback line FBL varies according to a position of the pixel PX, the feedback voltage Vfbs is selected or controlled considering the loss. The feedback voltage Vfbs is selected per frame cycle.

The A/D converter 630 converts the selected feedback voltage Vfbs into feedback data Dfb of a predetermined bit number (S13) and transmits the converted feedback data to the signal controller 600.

The signal controller 600 determines whether the nth gray corresponds to a maximum gray (e.g., 256th gray) (S14), and when the nth gray corresponds to the maximum gray, stores the feedback data Dfb for from 0 gray to the nth gray is stored in the lookup table 602 as the feedback gamma data (S16).

When the nth gray is not the maximum gray, the process goes back to step S11 so that steps 311 to S14 are repeated for an n+1th gray which is stepped up by one from the nth gray.

After step S16, the comparison processor 601 of the signal controller 600 compares the stored feedback gamma data with pre-stored target gamma data (S17). According to an embodiment, the comparison processor 601 compares pre-stored gamma data with the feedback gamma data.

As a result of comparing the feedback gamma data with the target gamma data, when the feedback gamma data is within a predetermined dispersion range (S18), the gamma data (e.g., gamma data for white) or the gamma data for each of R, G, and B is stored in the lookup table 602 as final gamma data (S21). An example of when the feedback gamma data is within the predetermined dispersion range is when a difference between the feedback gamma data and the target gamma data is within a predetermined range.

When it is determined in step S18 that the feedback gamma data is outside the predetermined dispersion range, the comparison processor 601 of the signal controller 600 compensates for the gamma data so that the feedback gamma data is close to the target gamma data (S19) and stores the compensated gamma data in the lookup table 602.

Next, to start the scan mode again, the minimum gray value (for example, "0") is inputted to n of the nth gray (S20) and the process returns to step S11.

According to the exemplary embodiment described in connection with FIG. 4, the compensation of the gamma data is performed sequentially by increasing the gray from the minimum gray to the maximum gray. However, the embodiments of the present invention are not limited thereto. According to an embodiment, as long as a process of compensating for the gamma data is repeatedly performed for the entire grays, the order of the grays may be changed.

As such, the compensation system and algorithm generate the feedback gamma data based on the feedback voltages obtained for all the grays for each panel and compensate for the gamma data (e.g., gamma data for white) or the independent gamma data for each of R, G to be suitable for each panel by using the generated feedback gamma data, so that the optimal gamma data for each display panel may be acquired, thereby increasing the display characteristics and reliability of the display device.

Hereinafter, a layout of one pixel of a display panel 300 in a gamma data compensation system according to an embodiment is described with reference to FIGS. 5 and 6.

Figure 5:
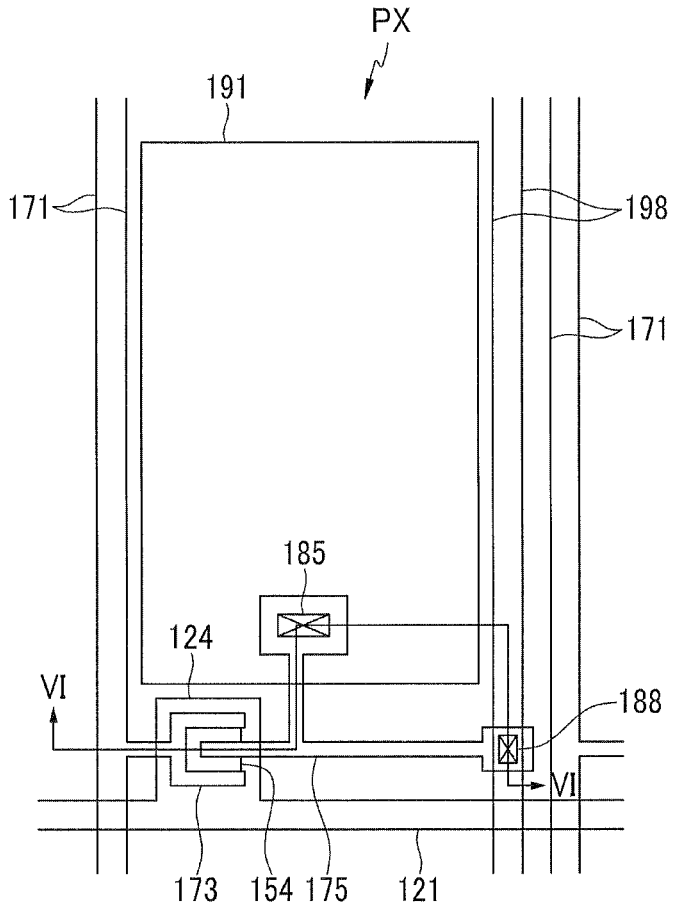
FIG. 5 is a layout view of a display device according to an exemplary embodiment of the present invention.
Figure 6:
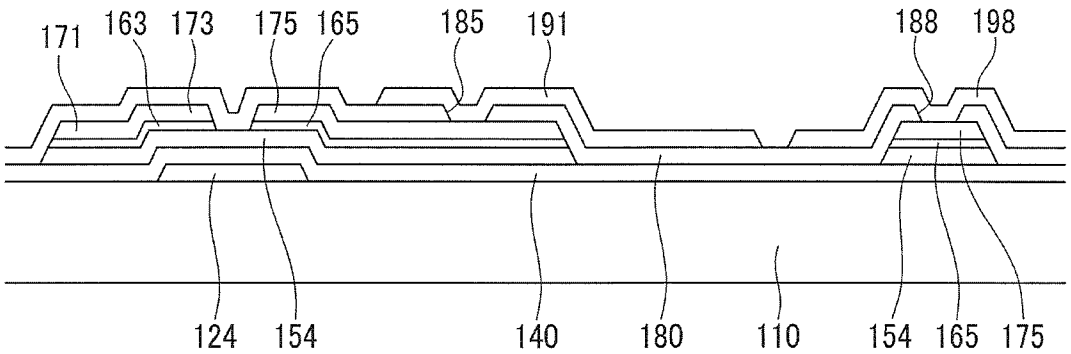
FIG. 6 is a cross-sectional view of the display device of FIG. 5 taken along line VI-VI.

FIG. 5 is a layout view of a display device according to an exemplary embodiment of the present invention, and FIG. 6 is a cross-sectional view of the display device of FIG. 5, which is taken along line VI-VI.

Referring to FIGS. 5 and 6, a gate line 121 including a gate electrode 124 is formed on an insulation substrate 110, and a gate insulating layer 140 is formed on the gate electrode 124. A semiconductor layer (not shown), ohmic contacts 163 and 165, a drain electrode 175, and a data line 171 are sequentially formed on the gate insulating layer 140. The data line 171 includes a source electrode 173 which faces the drain electrode 175 with respect to the gate electrode 124.

A passivation layer 180 is formed on the data line 171 and the drain electrode 175. The passivation layer 180 has contact holes 185 and 188 which each expose a part of respective corresponding drain electrode 175. The passivation layer 180 is made of an organic insulator or an inorganic insulator. When the passivation layer 180 is made of the organic insulator, the passivation layer 180 includes a low dielectric material having a low dielectric constant of 4.0 or less.

A pixel electrode 191 and a feedback line 198 are formed on the passivation layer 180. The pixel electrode 191 and the feedback line 198 are made of a transparent conductive material, such as ITO, IZO, or the like. The pixel electrode 191 is electrically connected with the drain electrode 175 through the contact hole 185 to receive a data voltage Vd. The feedback line 198 is directly and electrically connected with the drain electrode 175 through the contact hole 188. The data voltage is transmitted to the pixel electrode 191 as a pixel voltage, and the pixel voltage is transmitted as a feedback voltage to the multiplexer 640.

Figure 7:
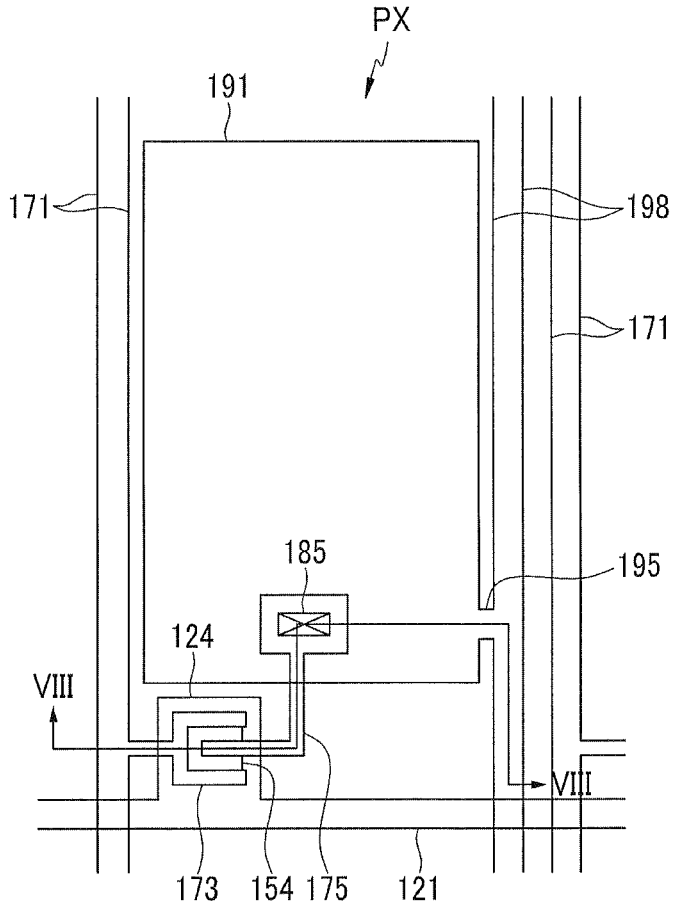
FIG. 7 is a layout view of a display device according to an exemplary embodiment of the present invention.

Next, a layout of a pixel PX according to an exemplary embodiment of the present invention is described with reference to FIGS. 7 and 8. FIG. 7 is a layout view of a display device according to an exemplary embodiment of the present invention, and FIG. 8 is a cross-sectional view of the display device of FIG. 7, which is taken along line VIII-VIII.

Figure 8:
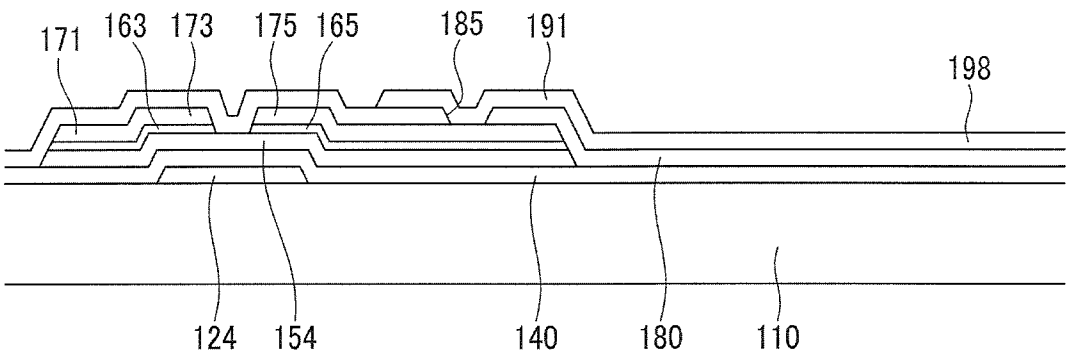
FIG. 8 is a cross-sectional view of the display device of FIG. 7 taken along line VIII-VIII.

The exemplary embodiment shown in FIGS. 7 and 8 is substantially the same as the display device shown in FIGS. 5 and 6 except that a feedback line 198 is directly connected with a pixel electrode 191 through a connector 195. The connector 195 is disposed in the same layer as the feedback line 198 and the pixel electrode 191 and made of a transparent conductive material, such as ITO, IZO, or the like. The feedback line 198 according to an exemplary embodiment directly receives a pixel voltage of the pixel electrode 191 and transmits the pixel voltage to the multiplexer 640.

While the embodiments of the invention have been described, it is to be understood that the invention is not limited to the embodiments, but, on the contrary, is intended to cover various modifications and equivalent arrangements included within the spirit and scope of the appended claims.

What is claimed is:

1. A system for compensating for gamma data, comprising:

a display panel including a plurality of pixels, a plurality of data lines and a plurality of gate lines connected to the plurality of pixels, and at least one feedback line connected to at least one pixel of the plurality of pixels;

a gray voltage generator generating a reference gray voltage based on first gamma data;

a data driver generating a data voltage based on the reference gray voltage and applying the generated data voltage to a data line of the plurality of data lines;

a multiplexer receiving at least one feedback voltage from the at least one feedback line, selecting a feedback voltage from the received at least one feedback voltage, and outputting the selected feedback voltage;

an A/D converter converting the feedback voltage selected by the multiplexer into feedback data; and a signal controller storing the feedback data as feedback gamma data for the entire grays and compensating for the first gamma data based on the feedback gamma data, wherein the signal controller comprises:

a lookup table storing the feedback gamma data; and a comparison processor comparing the feedback gamma data with target gamma data and compensating for the first gamma data when the feedback gamma data departs from a dispersion range, and wherein when the feedback gamma data is within the dispersion range, the signal controller stores the first gamma data as final gamma data in the lookup table.

2. The system of claim 1, wherein the feedback gamma data and the first gamma data are gamma data for white or green.

3. The system of claim 1, wherein the feedback gamma data and the first gamma data are gamma data for each of red, green, and blue.

4. The system of claim 1, wherein a pixel of the plurality of pixels comprises a switching element including an input terminal which is connected to the data line and a pixel electrode connected to an output terminal of the switching element, and wherein at least one of the output terminal of the switching element and the pixel electrode is connected to the feedback line.

5. The system of claim 4, wherein the feedback line is disposed in the same layer as the pixel electrode, and wherein the feedback line and the pixel electrode include a transparent conductive material.

6. The system of claim 5, wherein the plurality of gate lines extend in a row direction, and the plurality of data lines and the feedback line extend in a column direction.

7. A display device including the system of claim 1.

8. The display device of claim 7, wherein the signal controller comprises: a lookup table storing the feedback gamma data; and a comparison processor comparing the feedback gamma data with target gamma data and compensating for the first gamma data when the feedback gamma data departs from a dispersion range.

9. A method of compensating for gamma data, comprising:

generating and outputting a data voltage based on first gamma data;

feeding back at least one pixel voltage charged in at least one pixel;

selecting a feedback voltage from the at least one pixel voltage;

converting the selected feedback voltage into feedback data;

storing the feedback data as feedback gamma data for the entire grays, the feedback gamma data stored in a lookup table;

comparing the feedback gamma data;

compensating for the first gamma data when the feedback gamma data departs from a dispersion range; and storing the first gamma data as final gamma data in the lookup table when the feedback gamma data is within the dispersion range.

10. The method of claim 9, wherein generating and outputting the data voltage based on the first gamma data is performed for each gray of the entire grays.

11. The method of claim 10, further comprising:

generating and outputting a data voltage based on the compensated first gamma data.

12. The method of claim 11, wherein the feedback gamma data and the first gamma data are gamma data for white.

13. The method of claim 12, wherein selecting the feedback voltage includes selecting pixel voltages charged in three pixels representing different colors.

14. The method of claim 11, wherein selecting the feedback voltage includes selecting a pixel voltage charged in a pixel representing green.

15. The method of claim 11, wherein the feedback gamma data and the first gamma data are gamma data for each of red, green, and blue.

16. The method of claim 15, wherein selecting the feedback voltage includes selecting a pixel voltage charged in a pixel representing one color.

17. The method of claim 9, wherein the at least one pixel comprises a switching element and a pixel electrode connected to the switching element, and wherein feeding back the at least one pixel voltage includes using a feedback line connected to at least one of an output terminal of the switching element and the pixel electrode.

18. A gamma data compensation system for a display device comprising:

a gray voltage generator generating a gray voltage based on first gamma data;

a data driver applying a data voltage to a pixel electrode as a pixel voltage through a data line based on the gray voltage;

a converter receiving the pixel voltage as a feedback voltage from the pixel electrode through a feedback line and converting the feedback voltage into feedback data; and a signal controller storing the feedback data for entire grays as feedback gamma data and compensating for the first gamma data, wherein the signal controller comprises:

a lookup table storing the feedback gamma data; and a comparison processor comparing the feedback gamma data with target gamma data and compensating for the first gamma data when the feedback gamma data departs from a dispersion range, and wherein when the feedback gamma data is within the dispersion range, the signal controller stores the first gamma data as final gamma data in the lookup table.

* * * * *